US007170336B2

(12) United States Patent
Hsu

(10) Patent No.: US 7,170,336 B2
(45) Date of Patent: Jan. 30, 2007

(54) LOW VOLTAGE BANDGAP REFERENCE (BGR) CIRCUIT

(75) Inventor: Jenshou Hsu, Hsin-Chu (TW)

(73) Assignee: Etron Technology, Inc., Hsin-Chu (TW)

( * ) Notice: Subject to any disclaimer, the term of this patent is extended or adjusted under 35 U.S.C. 154(b) by 69 days.

(21) Appl. No.: 11/056,796

(22) Filed: Feb. 11, 2005

(65) Prior Publication Data

US 2006/0181335 A1 Aug. 17, 2006

(51) Int. Cl.
*G05F 1/10* (2006.01)

(52) U.S. Cl. ..... 327/539

(58) Field of Classification Search ..... 327/539–541, 327/543, 546; 323/313–316
See application file for complete search history.

(56) References Cited

U.S. PATENT DOCUMENTS

| | | | | |
|---|---|---|---|---|
| 5,508,604 | A * | 4/1996 | Keeth | 323/314 |
| 6,281,743 | B1 | 8/2001 | Doyle | 327/539 |
| 6,489,835 | B1 | 12/2002 | Yu et al. | 327/539 |
| 6,501,299 | B2 * | 12/2002 | Kim et al. | 326/83 |
| 6,529,066 | B1 | 3/2003 | Guenot et al. | 327/539 |
| 6,531,857 | B2 | 3/2003 | Ju | 323/316 |
| 6,531,911 | B1 * | 3/2003 | Hsu et al. | 327/512 |
| 6,563,371 | B2 * | 5/2003 | Buckley et al. | 327/539 |
| 6,566,850 | B2 | 5/2003 | Heinrich | 323/313 |
| 6,605,987 | B2 | 8/2003 | Eberlein | 327/540 |
| 6,788,041 | B2 | 9/2004 | Gheorghe et al. | 323/313 |
| 6,930,538 | B2 * | 8/2005 | Chatal | 327/539 |
| 2004/0155700 | A1 | 8/2004 | Gower et al. | 327/543 |
| 2004/0169549 | A1 | 9/2004 | Liu | 327/539 |

OTHER PUBLICATIONS

"A CMOS Bandgap Reference Circuit with Sub-1-V Operation", by Banba et al, IEEE Jrnl. of Solid-State Cir., vol. 34, No. 5, May 1999, pp. 670-673.

"A CMOS Subbandgap Reference Circuit with 1-V Power Supply Voltage", by Doyle et al., IEEE Jrnl. of Solid-State Cir., vol. 39, No. 1, Jan. 2004, pp. 252-255.

* cited by examiner

*Primary Examiner*—My-Trang Nu Ton
(74) *Attorney, Agent, or Firm*—Saile Ackerman LLC; Stephen B. Ackerman

(57) ABSTRACT

A low voltage bandgap reference circuit based on a current summation technique where reference voltages with positive and negative temperature coefficients are generated by a first circuit. These reference voltages are coupled to amplifying circuits which generate reference voltages with equal and opposite temperature coefficients based on the ratio of resistors in these amplifying circuits, thereby producing a temperature independent reference voltage. The current from each of these amplifying circuits is then summed in a summing resistor, where the size of the resistor determines the magnitude of the temperature independent reference voltage.

21 Claims, 9 Drawing Sheets

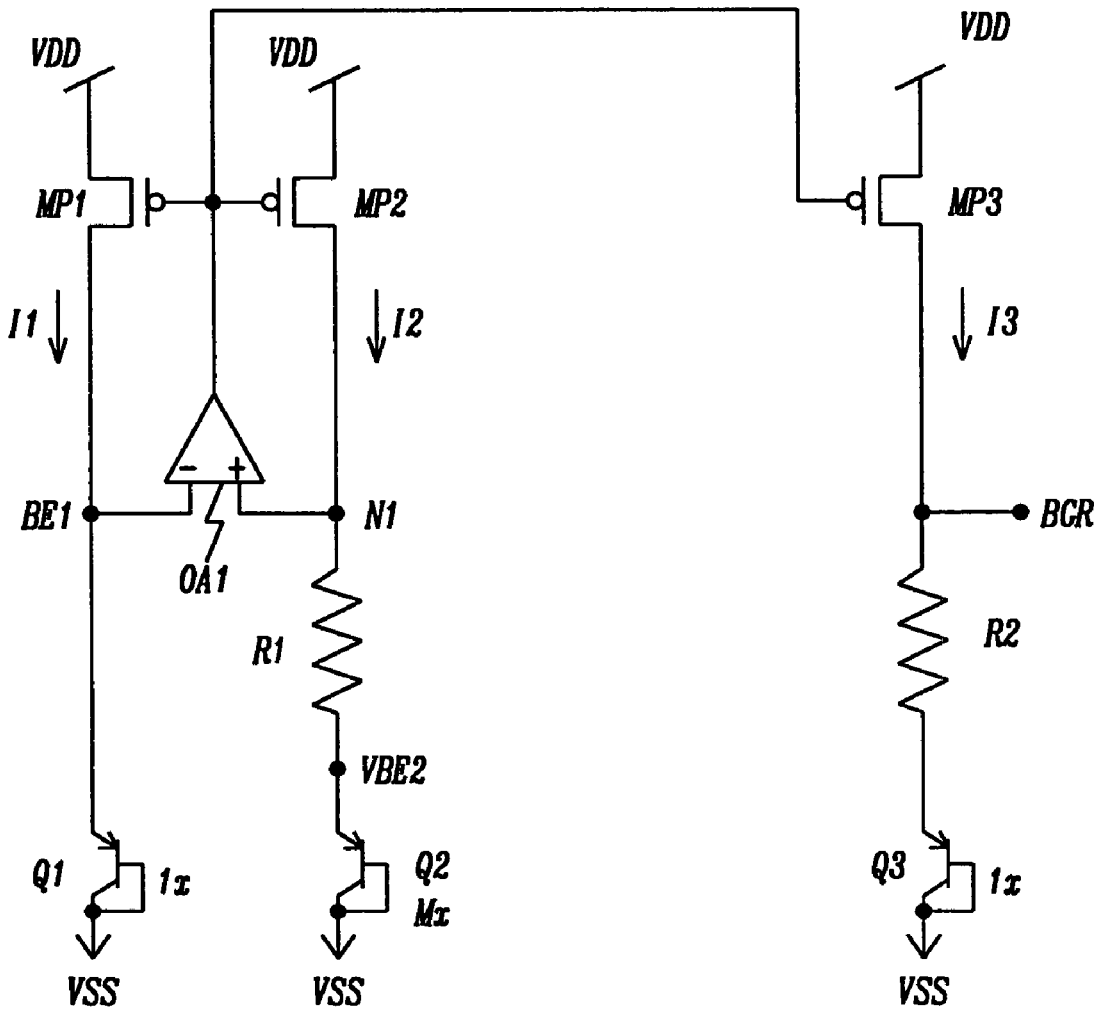
FIG. 1a – Prior Art

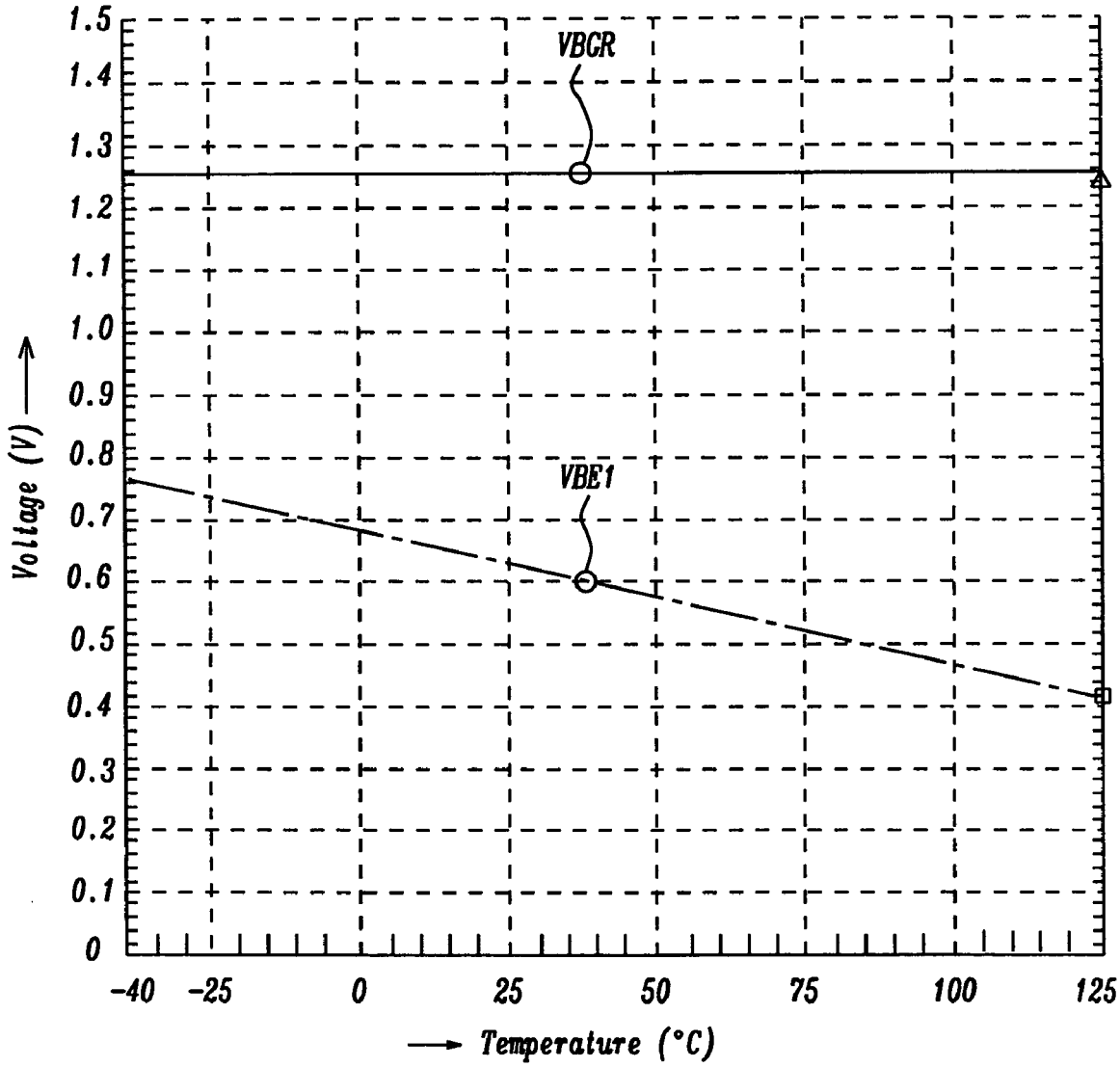
FIG. 1b – Prior Art

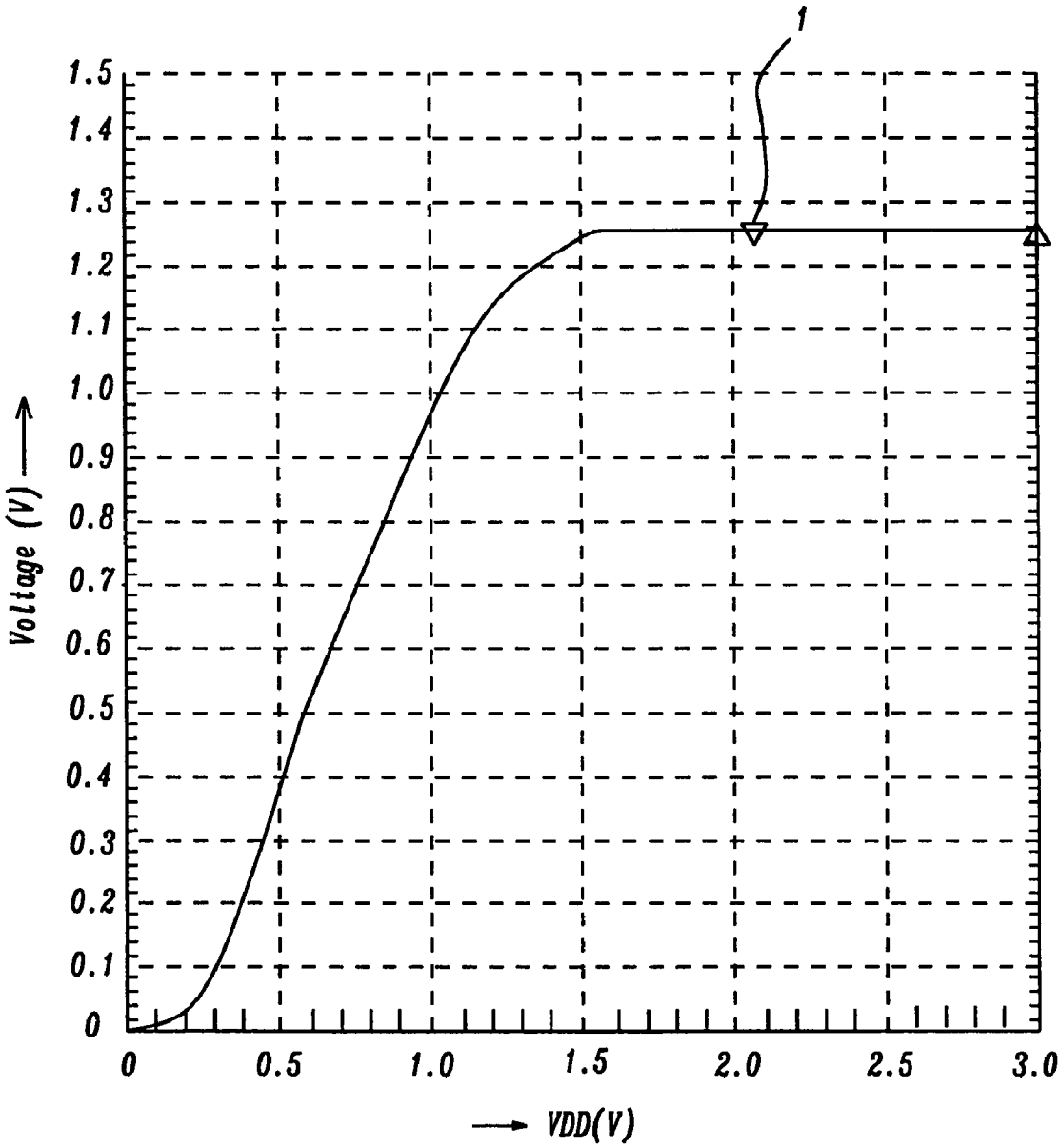
FIG. 1c – Prior Art

LOW VOLTAGE BANDGAP REFERENCE (BGR) CIRCUIT

BACKGROUND OF THE INVENTION

1. Field of the Invention

The invention relates to temperature-stabilized reference voltage circuits, and more particularly to a sub-1-V bandgap reference circuit using a low supply voltage.

2. Description of the Related Art

Reference circuits are necessary in many applications ranging from memory, analog, mixed-mode to digital circuits. The demand for a low voltage reference is especially apparent in mobile battery-operated products. Low voltage operation is also a trend of process technology advancement. It is difficult to approach a stable operation in conventional bandgap reference (BGR) circuits when the supply voltage is under 1.5 V. As a result, the demand for a new bandgap reference circuit technique which is stable and operated at low supply voltages is inevitable.

For a discussion of bandgap reference circuits with below 1.5 V power supply voltages refer to:

H. Banba, H. Shiga, A. Umezawa, T. Miyaba, T. Tanzawa, S. Atsumi, and K. Sakui, "A CMOS Bandgap Reference Circuit with Sub-1-V Operation," in IEEE Journal of Solid-State Circuits, Vol. 34, No. 5, pp. 670–673, May 1999, which describes a BGR circuit where $V_{ref}$ has been converted from the sum of two currents; one is proportional to $V_f$ and the other is proportional to $V_T$, and J. Doyle, Y. J. Lee, Y.-B. Kim, H. Wilsch, and F. Lombardi, "A CMOS Subbandgap Reference Circuit With 1-V Power Supply Voltage," in IEEE Journal of Solid-State Circuits, Vol. 39, No. 1, pp. 252–255, January 2004, where threshold voltage reduction and subthreshold operation techniques are used. Large $\Delta V_{BE}$ (100 mV) as well as a 90-dB operational amplifier are used to circumvent the amplifier offset.

Shown in FIG. 1*a* is one example of a conventional CMOS BGR circuit which is composed of a CMOS op-amp OA1, a current mirror comprising MP1, MP2, MP3, diode-wired transistors Q1, Q2, Q3, and resistors R1, R2, all implemented in the standard CMOS process. VDD and VSS are the power supply rails. The area ratio of Q1, Q2, Q3 is Q1:Q2:Q3=1:M:1. Transistors MP1, MP2, MP3 supply currents I1, I2, I3, respectively. The voltage $V_{BE1}$ is seen at node BE1, voltage $V_{N1}$ is seen at node N1, voltage $V_{BE2}$ is seen at node VBE2, and voltage $V_{BGR}$ is seen at output node BGR.

The current versus voltage relation of a general diode is expressed as:

$$I_D = I_S \cdot (e^{\frac{q \cdot V_D}{k \cdot T}} - 1) \tag{1}$$

If $$V_D \gg \frac{kT}{q},$$

then eq. (1) can be approximated as $$I_D \cong I_S \cdot e^{\frac{q \cdot V_D}{k \cdot T}} \tag{2}$$

solving for $V_D$:

$$V_D = \frac{k \cdot T}{q} \cdot \ln\frac{I_D}{I_S} = V_T \cdot \ln\frac{I_D}{I_S} \tag{3}$$

where k is Boltzmann's constant ($1.38\times10^{-23}$ J/K), q is the electron charge ($1.6\times10^{-19}$ C), T is the absolute temperature (K), $V_D$ is the voltage across the diode, $I_D$ is the diode current, $I_S$ is the saturation current, and $V_T$ is the thermal voltage=(k·T)/q.

The PMOS transistor dimensions of MP1, MP2, and MP3 are the same. Therefore the currents I1, I2, and I3 have the same value because their gates are connected to a common node.

$$\left(\frac{W}{L}\right)_{MP1} = \left(\frac{W}{L}\right)_{MP2} = \left(\frac{W}{L}\right)_{MP3} \tag{4}$$

$$I_1 = I_2 = I_3 = I \tag{5}$$

using (3) and (4), $V_{BE1}$ and $V_{N1}$ in FIG. 1*a* can be expressed as:

$$V_{BE1} = V_T \ln\frac{I}{I_S} \tag{6}$$

$$V_{N1} = I \cdot R1 + V_T \cdot \ln\frac{I}{M \cdot I_S} \tag{7}$$

where M is the area ratio between diodes Q1 and Q2 (Q1:Q2=1:M; thus M=Q2/Q1) and where $V_{BE1}$ is the base-emitter voltage drop of a bipolar transistor or the diode turn-on voltage. Because $V_{BE1}$ and $V_{N1}$ are a pair of input voltages for the op-amp, they are controlled to be the same voltage.

$$V_{BE1} = V_{N1} \tag{8}$$

Using (6), (7), and (8), I is given by:

$$I = \frac{V_T}{R1} \cdot \ln \cdot M \tag{9}$$

Using (9), the conventional BGR, the output voltage $V_{BGR}$ becomes $$V_{BGR} = I \cdot R2 + V_{BE1} = \frac{R2}{R1} \cdot V_T \cdot \ln \cdot M + V_{BE1} \tag{10a}$$

Where $V_{BE1}$ has a negative temperature coefficient of about −1.5 mV/K as shown in FIG. 1*b*, whereas $V_T$ has a positive temperature coefficient of about +0.087 mV/K, so that $V_{BGR}$ is determined by the resistance ratio of R2/R1 and the area ratio of diode-wired transistors Q1, Q2. FIG. 1*b* is a graph of the simulation results of the prior art bandgap circuit relating temperature in ° C. on the horizontal axis to voltage in Volt on the vertical axis for Curve $V_{BE1}$ and Curve $V_{BGR}$ (output voltage). Thus $V_{BGR}$ is controlled to be about 1.25 V where the temperature dependence of $V_{BGR}$ becomes negligibly small. As a result, the supplied voltage can not be lower than 1.25 $V_{DS}$+$V_{DS3}$, which limits the low voltage design for CMOS circuits as shown in FIG. 1*c*, Curve 1. FIG. 1*c* is a graph of the simulation results of the prior art bandgap circuit relating the supply voltage $V_{DD}$ in Volt on the horizontal axis versus the bandgap reference output voltage $V_{BGR}$ in Volt on the vertical axis.

A review of the prior art U.S. patents has yielded the following related patents:

U.S. Pat. No. 6,788,041 (Gheorghe et al.) discloses a bandgap reference circuit which when operating with a voltage source in the range from 1.0 to 1.2 volt provides a Vref output of about 242 and 245 mV, respectively, utilizing a PTAT current source.

U.S. Pat. No. 6,605,987 (Eberlein) teaches a temperature-stabilized reference voltage circuit using the current-mode technique, in which two partial currents are superimposed on each other and converted into the reference voltage. The circuit permits the implementation of low temperature-compensated output voltages below 1.0 V.

U.S. Pat. No. 6,529,066 (Guenot et al.) shows a bandgap circuit producing an output of 1.25 V and utilizing parasitic vertical PNP transistors operating at different current densities. A difference in the base-emitter voltages is developed across a resistor to produce a current with a positive temperature coefficient. When combined with another voltage with a negative temperature coefficient a bandgap reference voltage is produced.

U.S. Pat. No. 6,566,850 (Heinrich) describes a bandgap reference circuit, which includes a sensing circuit and a current injector circuit, that can transition quickly to a desired operational state by injecting bootstrap current into an internal node of the bandgap reference circuit. The bandgap reference circuit is effective with a low voltage power supply (e.g., 1–1.5 V).

U.S. Pat. No. 6,531,857 (Ju) presents a bandgap reference circuit which has a segmented resistor coupled across the emitter-base terminals of a PNP transistor to generate a $V_{BE}$ current. The resistor sums this $V_{BE}$ current with a PTAT current and generates a Vref voltage, where Vref can be less than $V_{EB}$. $V_{EB}$ typically is less than or equal to 0.7 V, resulting in a $V_{DD}$ voltage of equal or larger than 0.85 V.

U.S. Pat. No. 6,489,835 (Yu et al.) discloses a bandgap reference circuit which operates with a voltage supply that can be less than 1 V and where only one non-zero current operating point is available. The bandgap reference circuit comprises a core circuit with an embedded current generator, and a bandgap reference generator with output $V_{BG}$.

U.S. Pat. No. 6,281,743 (Doyle) describes a sub-bandgap reference circuit yielding a reference voltage smaller than the bandgap voltage of silicon. The generation of the reference signal includes generating first and second signals with negative and positive temperature coefficients, respectively. The first and second signals are then sampled and stored on first and second capacitors. A low impedance path between these capacitors yields the reference signal. Simulation shows a stable sub-bandgap reference output of 0.605 V using a supply voltage of only 1 V.

U.S. Patent Application Publication US 2004/0169549 A1 (Liu) presents a bandgap reference circuit comprising an op-amp, a plurality of MOS transistors coupled to the op-amp, a plurality of resistors and bipolar transistors coupled to the MOS transistors. Simulation and measurement results indicate that Vref, generated by the bandgap reference circuit, is within the range of 1.18 to 1.2 V from −40° C. to 120° C.

U.S. Patent Application Publication 2004/0155700 A1 (Gower et al.) teaches a bandgap reference voltage generator with low voltage operation comprising a first closed-loop circuit having a first current with a positive temperature coefficient, and a second closed-loop circuit having a second current with a negative temperature coefficient. The bandgap reference voltage generator includes a multitude of output stages where each output may be independently scaled to have either a zero, a positive or a negative temperature coefficient.

A problem of many of the prior art circuits is that they tend not to be stable until the supply voltage is larger than 1.5 V or require additional components, such as capacitors which take considerable area, for stable operation at low supply voltages. Clearly a BGR circuit is desirable which can work down to sub-1-V supply voltages which is stable, simple to integrate, and has low cost.

SUMMARY OF THE INVENTION

It is an object of at least one embodiment of the present invention to provide circuits and a method for a temperature independent voltage bandgap reference circuit which is capable of working down to sub-1-Volt.

It is another object of the present invention to provide a circuit which utilizes standard CMOS processes.

It is yet another object of the present invention to provide a bandgap reference circuit which is stable at supply voltages below 1.5 V.

It is still another object of the present invention to allow adjustment of the positive and negative temperature coefficients.

It is a further object of the present invention is to allow adjustment of the temperature coefficient to an arbitrarily selected value.

It is yet a further object of the present invention is to provide for a fractional bandgap reference voltage.

It is still a further object of the present invention is to provide a fractional bandgap reference voltage which, regardless of its chosen value, is temperature independent.

These and many other objects have been achieved utilizing first a circuit which produces positive and negative reference voltages based on the area ratio of 1:M of two diode type devices or diode-connected transistors and the ratio of two resistive means. Secondly, these two reference voltages are driving a summing circuit, each using current sources and resistive means to generate a current which is dependent on the ratio of the positive reference voltage and a resistive means, and the ratio of the negative reference voltage and another resistive means. These currents are then summed using a final resistive means which produces the fractional temperature-independent sub-bandgap reference voltage. The magnitude of the fractional, temperature independent sub-bandgap reference voltage is determined by selecting a specific value for that final resistive means. The current sources of each summing circuit may have equal (W/L) ratios or, depending on the circuit implementation, the ratios of each of these current sources may be N:1 (where N is larger than or equal to 1) for one current source and P:1 (where P is larger than or equal to 1) for the other current source.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 1*a* is a BGR circuit diagram of the related art.

FIG. 1*b* is a graph of the BGR circuit of the related art comparing temperature versus reference voltage.

FIG. 1*c* is a graph of the BGR circuit of the related art comparing supply voltage versus reference voltage.

Use of the same reference number in different figures indicates similar or like elements.

DESCRIPTION OF THE PREFERRED EMBODIMENT

A new low voltage bandgap reference circuit (BGR) is proposed which will be described in detail below. The circuit uses current summation techniques to implement the temperature compensation and is capable of working down to sub-1-V using standard CMOS processes.

BGR Circuit 1

Figure 2A:
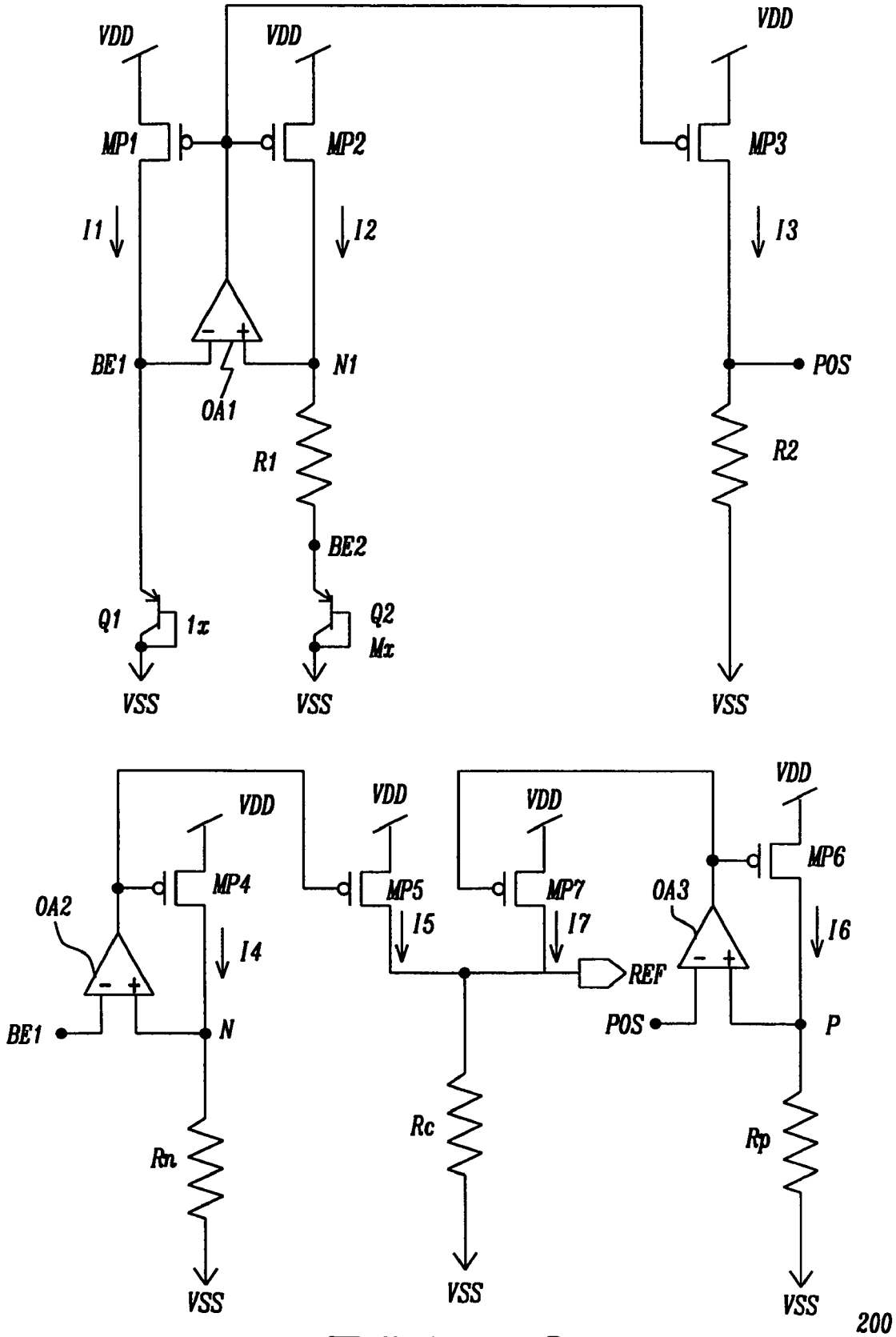
FIG. 2*a* is circuit diagram of a BGR circuit of a first preferred embodiment of the present invention.

Circuit 200 of FIG. 2*a* illustrates a first preferred embodiment of the present invention. FIG. 2*a* comprises a CMOS op-amp OA1, a current mirror with PMOS transistors MP1, MP2, MP3, diode-wired transistors Q1, Q2, and resistors R1, R2, all implemented in the standard CMOS process. VDD and VSS are the positive and negative power supply rails, respectively. Nodes BE1 and N1 are coupled to the minus and plus inputs of OA1, respectively. Nodes BE1 (alternatively node BE2) and POS are outputs which connect to inputs of op-amps OA2, OA3, respectively, described next. Resistor R1 is coupled between node N1 and Q2, resistor R2 is coupled between node POS and VSS. The area ratio of Q1 and Q2 is Q1:Q2=1:M. Current source transistors MP1, MP2, MP3 have the same (W/L) ratio and supply currents I1, I2, I3, respectively. The voltage $V_{BE1}$ is seen at node BE1, voltage $V_{N1}$ is seen at node N1, voltage $V_{BE2}$ is seen at node BE2, voltage $V_{POS}$ is seen at node POS, voltage $V_p$ is seen at node P, voltage $V_N$ is seen at node N, and voltage $V_{REF}$ is seen at output node REF.

PMOS transistor MP4 and resistor Rn are serially coupled between VDD and VSS. The junction of MP4 and Rn is node N. Inputs BE1 (or alternately BE2) and node N are coupled to the minus and plus inputs of OA2, respectively. The output of OA2 couples to the gates of current source transistors MP4 and MP5. PMOS transistor MP5 and summing resistor Rc are serially coupled between VDD and VSS. The junction of MP5 and Rc is output $V_{REF}$. PMOS transistor MP6 and resistor Rp are serially coupled between VDD and VSS. The junction of MP6 and Rp is node P. Input POS and node P are coupled to the minus and plus inputs of OA3, respectively. The output of OA3 couples to the gates of current source transistors MP6 and MP7. Coupled in parallel to MP5 is PMOS transistor MP7. Transistors MP4, MP5, MP6, MP7 supply currents I4, I5, I6, I7, respectively.

As already stated above:

$$\left(\frac{W}{L}\right)_{MP1} = \left(\frac{W}{L}\right)_{MP2} = \left(\frac{W}{L}\right)_{MP3} \text{ therefore:}$$

$$I_1 = I_2 = I_3 = I$$

using eq. (9)

$$V_{Pos} = I \cdot R2 = \frac{V_T}{R1} \cdot \ln \cdot M \cdot R2 = \frac{R2}{R1} \cdot V_T \cdot \ln \cdot M \tag{10b}$$

$$\left(\frac{W}{L}\right)_{MP4} = \left(\frac{W}{L}\right)_{MP5} \Rightarrow 14 = 15 \tag{11}$$

$$\left(\frac{W}{L}\right)_{MP6} = \left(\frac{W}{L}\right)_{MP7} \Rightarrow 16 = 17 \tag{12}$$

Because $V_{BE1}$ and $V_N$ are a pair of input voltages for the op-amp, they would be controlled to be the same voltage:

$$V_{BE1} = V_N \tag{13}$$

$$I4 = \frac{V_N}{Rn} = \frac{V_{BE1}}{Rn} \tag{14}$$

Because $V_{POS}$ and $V_P$ are a pair of input voltages for the op-amp, they would be controlled to be the same voltage.

$$V_{POS} = V_P \tag{15}$$

$$I6 = \frac{V_P}{Rp} = \frac{V_{POS}}{Rp} \tag{16}$$

from (11) and (13)

$$I5 = \frac{V_{BE1}}{Rn} \tag{17}$$

from (12) and (14)

$$I7 = \frac{V_{POS}}{Rp} \tag{18}$$

$$V_{REF} = Rc(I5 + I7) \tag{19}$$

Using (17), (18), and (19)

$$V_{REF} = V_{BE1} \cdot \left(\frac{Rc}{Rn}\right) + V_{POS} \cdot \left(\frac{Rc}{Rp}\right) \tag{20}$$

from (10b) we know that $$V_{POS} = \frac{R2}{R1} \cdot V_T \cdot \ln \cdot M$$

which has a positive temperature coefficient of about $$\left(+0.087 \cdot \mathrm{mV}/K \times \frac{R2}{R1} \times \ln \cdot M\right).$$

Figure 2B:
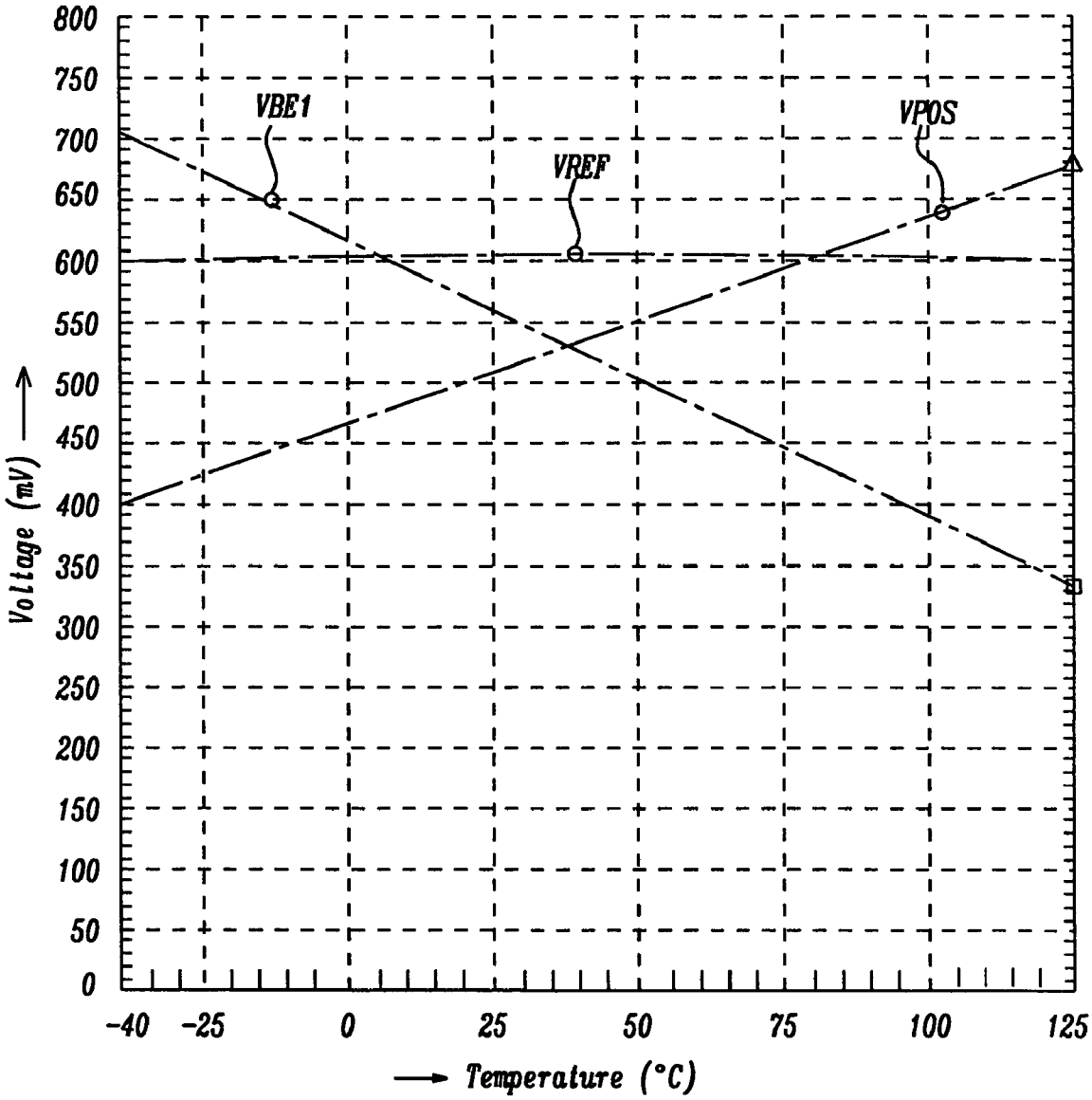
FIG. 2*b* is a graph of the BGR circuit of FIG. 2*a* for voltage nodes relating temperature versus voltage.

After R1, R2, and M are determined, we can choose the ratio of Rn and Rp to obtain a $V_{REF}$ whose temperature dependence becomes negligibly small as shown in the graph of FIG. 2*b*. We can therefore choose different values of Rc to obtain different $V_{REF}$ voltages. FIG. 2*b* is graph of the simulation results of the proposed bandgap circuit relating temperature in ° C. on the horizontal axis to voltage in mVolt on the vertical axis for Curves $V_{BE1}$, $V_{POS}$, and the output voltage $V_{REF}$. Curve $V_{BE1}$ has a negative slope, Curve $V_{POS}$ has a positive slope, resulting in Curve $V_{REF}$ with a slope which is essentially zero throughout the temperature range of −40 to +125° C.

Figure 2C:
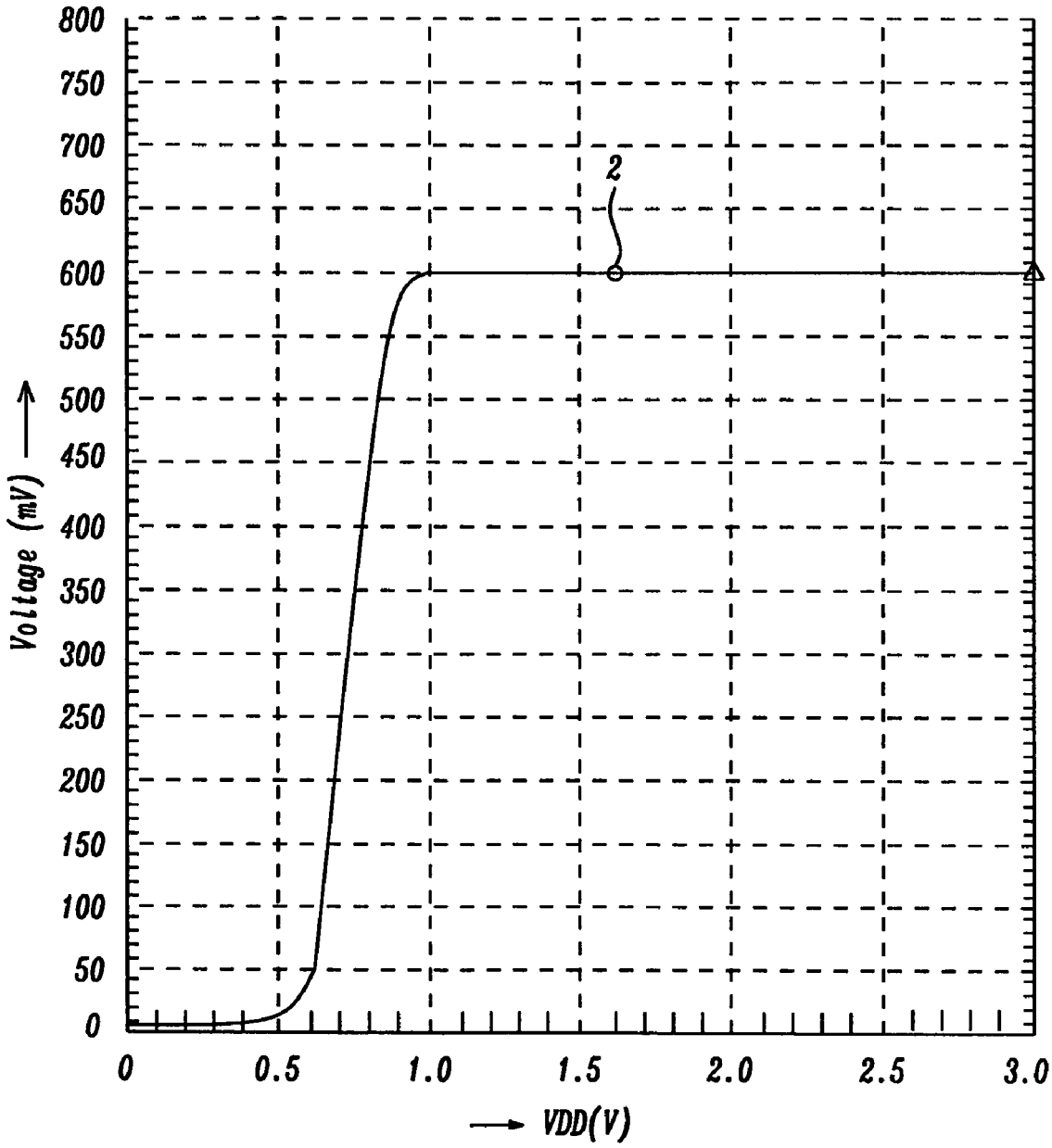
FIG. 2*c* is a graph of the BGR circuit of FIG. 2*a* for the output reference voltage relating supply voltage versus voltage.

Once we have a temperature independent $V_{REF}$ by choosing a suitable $$\frac{Rn}{Rp}$$

ratio, selecting the different values of Rc would not destroy the temperature independent characteristic of $V_{REF}$ but would just change the absolute value of $V_{REF}$. Therefore we can choose a suitable value of Rc so that the voltage of $V_{REF}$ is smaller than the external supply voltage. An example is shown in the graph of FIG. 2*c*, Curve 2, which relates the supply voltage $V_{DD}$ in Volt on the horizontal axis to voltage in mVolt on the vertical axis for the BGR circuit output voltage $V_{REF}$. Curve 2 shows that $V_{REF}$=0.6 V and that its value is almost a constant when $V_{DD}$>1.0 V. From the simulation results of FIGS. 2*b* and 2*c*, we find that the proposed first preferred embodiment of the BGR circuit can be applied to sub-1-V external voltage systems.

BGR Circuit 2

Figure 3:
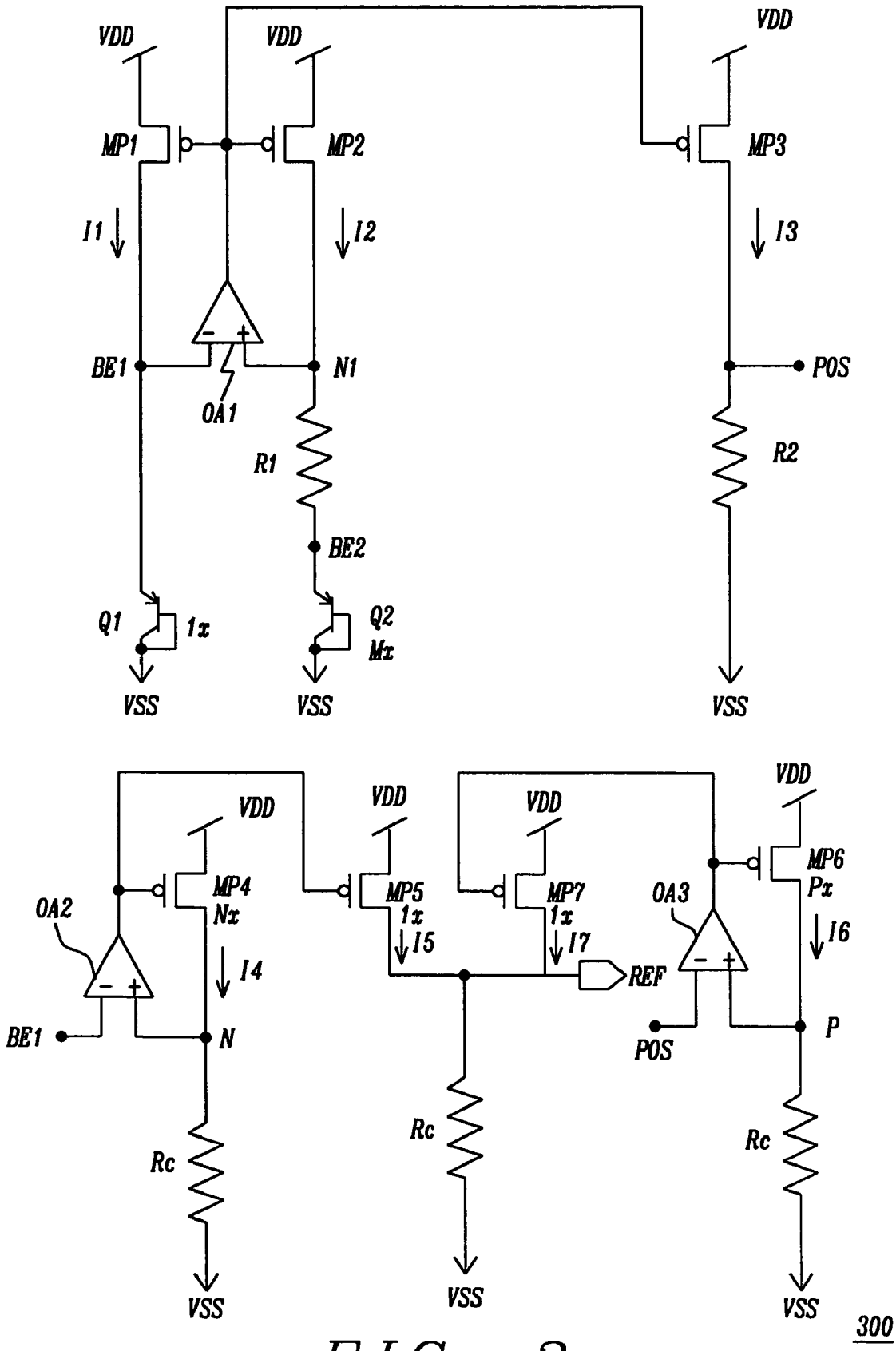
FIG. 3 is a circuit diagram of a BGR circuit of a second preferred embodiment of the present invention.

With reference to circuit 300 of FIG. 3, we now discuss a second preferred embodiment of the present invention. The only changes in FIG. 3 over FIG. 2*a* are that (a) resistors Rn and Rp are replaced by resistors Rc so that there are three resistors Rc, all having the same value, and (b) the W/L ratios of MP4 and MP5, and MP6 and MP7 are different. Elements previously discussed are indicated by like numerals and need not be described further.

Note:

MP4:MP5=N:1

MP6:MP7=P:1

$$\left(\frac{W}{L}\right)_{MP4} = N \cdot \left(\frac{W}{L}\right)_{MP5} \Rightarrow I4 = N \cdot I5 \tag{21}$$

$$\left(\frac{W}{L}\right)_{MP6} = P \cdot \left(\frac{W}{L}\right)_{MP7} \Rightarrow I6 = P \cdot I7 \tag{22}$$

therefore $$V_{REF} = (I5 + I7) \cdot Rc = \left[\left(\frac{I4}{N}\right) + \left(\frac{I6}{P}\right)\right] \cdot Rc$$

$$V_{REF} = \left(\frac{1}{N} \cdot \frac{V_N}{Rc} + \frac{1}{P} \cdot \frac{V_P}{Rc}\right) \cdot Rc = \frac{V_N}{N} + \frac{V_P}{P}$$

$$V_{REF} = \frac{1}{N} V_{BE1} + \frac{1}{P} V_{POS} \tag{23}$$

After R1, R2, and M are determined, we can choose the ratio of N and P to obtain a $V_{REF}$ whose temperature dependence becomes negligibly small.

BGR Circuit 3

Figure 4:
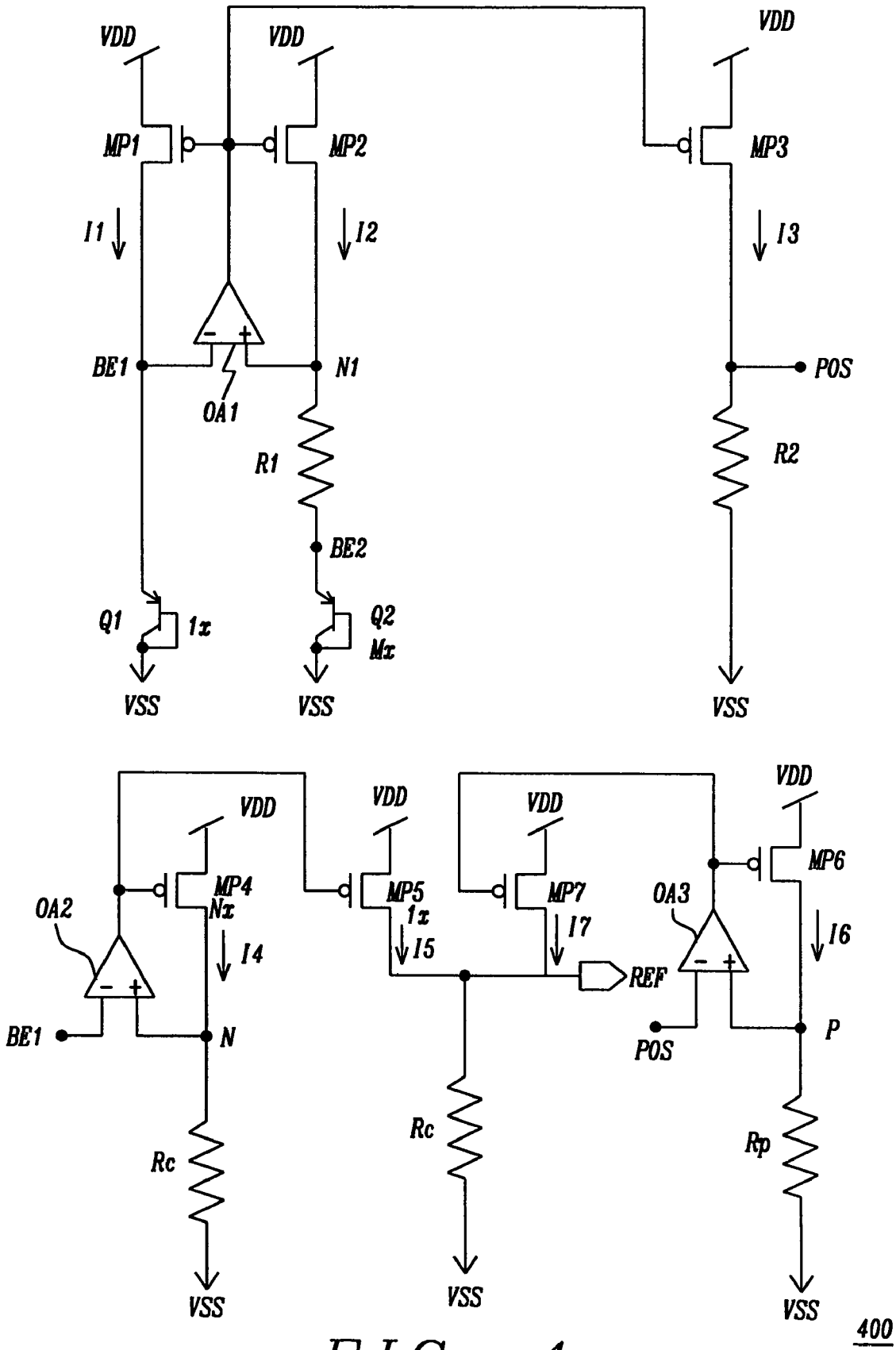
FIG. 4 is a circuit diagram of a BGR circuit of a third preferred embodiment of the present invention.

With reference to circuit 400 of FIG. 4, we now discuss a third preferred embodiment of the present invention. The only changes in FIG. 4 are that (a) resistor Rn is replaced by resistor Rc so that there are two resistors Rc both with the same value, and (b) the W/L ratios of MP4 and MP5 are different. Elements previously discussed are indicated by like numerals and need not be described further.

Note:

MP4:MP5=N:1

$$\left(\frac{W}{L}\right)_{MP4} = N \cdot \left(\frac{W}{L}\right)_{MP5} \Rightarrow I4 = N \cdot I5 \tag{24}$$

$$\left(\frac{W}{L}\right)_{MP6} = \left(\frac{W}{L}\right)_{MP7} \Rightarrow I6 = I7 \tag{25}$$

therefore $$V_{REF} = (I5 + I7)Rc = \left(\frac{I4}{N} + I6\right) \cdot Rc$$

$$V_{REF} = \left(\frac{1}{N} \cdot \frac{V_N}{Rc} + \frac{V_P}{Rp}\right) \cdot Rc$$

$$V_{REF} = \frac{1}{N} V_{BE1} + \left(\frac{Rc}{Rp}\right) \cdot V_{POS} \tag{26}$$

After R1, R2, and M are determined, we can choose the ratio of $$\frac{1}{N} \text{ and } \frac{Rc}{Rp}$$

to obtain a $V_{REF}$ whose temperature dependence becomes negligibly small.

Figure 5:
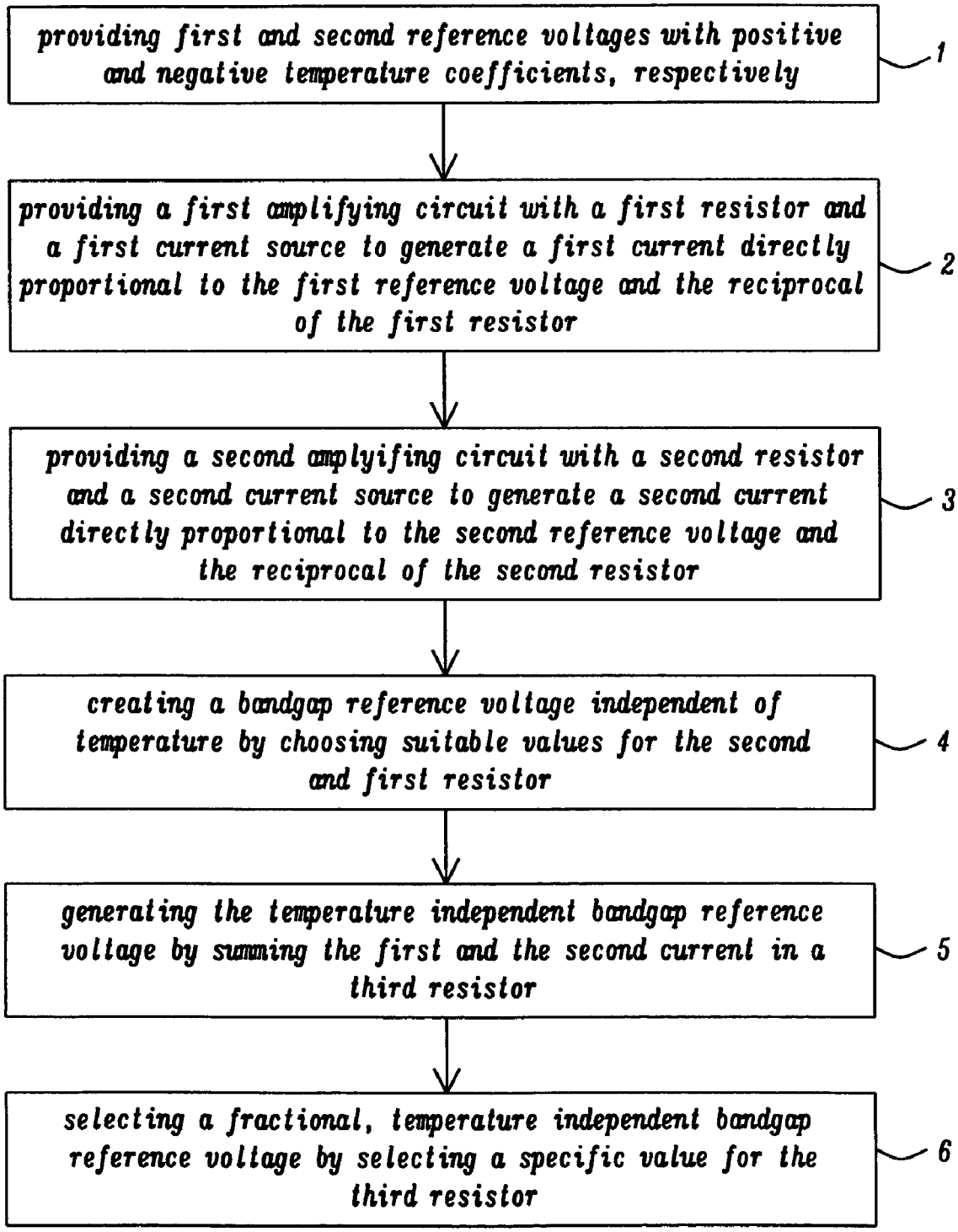
FIG. 5 is a block diagram of the method of the present invention.

We now describe the method of the invention with reference to FIG. 5:

Block 1 provides first and second reference voltages with positive and negative temperature coefficients, respectively.

Block 2 provides a first amplifying circuit with a first resistor and a first current source to generate a first current directly proportional to the first reference voltage and the reciprocal of the first resistor.

Block 3 provides a second amplifying circuit with a second resistor and a second current source to generate a second current directly proportional to the second reference voltage and the reciprocal of the second resistor.

Block 4 creates a bandgap reference voltage independent of temperature by choosing suitable values for the second and first resistor.

Block 5 generates the temperature independent bandgap reference voltage by summing the first and the second current in a third resistor.

Block 6 selects a fractional, temperature independent bandgap reference voltage by selecting a specific value for the third resistor.

While the invention has been particularly shown and described with reference to the preferred embodiments thereof, it will be understood by those skilled in the art that various changes in form and details may be made without departing from the spirit and scope of the invention.

What is claimed is:

1. A low voltage bandgap reference circuit, comprising:

a reference circuit generating a first reference voltage with a negative temperature coefficient at a first output and a second reference voltage with a positive temperature coefficient at a second output;

a first amplifying circuit coupled to said first output of said reference circuit, said first amplifying circuit comprising a first and a second current source, said first current source coupled to a first resistive means, where said first and said second current sources generate currents directly proportional to said first reference voltage and the reciprocal of said first resistive means;

a second amplifying circuit coupled to said second output of said reference circuit, said second amplifying circuit comprising a third and a fourth current source, said third current source coupled to a second resistive means, where said third and said fourth current sources generate currents directly proportional to said second reference voltage and the reciprocal of said second resistive means; and a summing circuit coupled to a junction of said second and fourth current source, said summing circuit summing the currents of said second and fourth current source through a third resistive means, thereby generating a temperature independent output reference voltage proportional to the magnitude of said third resistive means.

2. The low voltage bandgap reference circuit of claim 1, wherein current source switching means in said reference circuit have the same width-to-length ratio.

3. The low voltage bandgap reference circuit of claim 1, wherein first and second diode elements of said reference circuit have an area ratio of 1:M, where M is larger than 1.

4. The low voltage bandgap reference circuit of claim 1, wherein said first reference voltage with a negative temperature coefficient is derived from the voltage drop of diode-like means.

5. The low voltage bandgap reference circuit of claim 1, wherein said second reference voltage with a positive temperature coefficient is derived from the difference of voltage drops of diode-like means with different area ratios.

6. The low voltage bandgap reference circuit of claim 1, wherein switching means in said first amplifying circuit have the same width-to-length ratio.

7. The low voltage bandgap reference circuit of claim 1, wherein switching means in said second amplifying circuit have the same width-to-length ratio.

8. The low voltage bandgap reference circuit of claim 1, wherein switching means in said first amplifying circuit have a width-to-length ratio of N:1, where N is larger than or equal to 1.

9. The low voltage bandgap reference circuit of claim 1, wherein switching means in said second amplifying circuit have a width-to-length ratio of P:1, where P is larger than or equal to 1.

10. The low voltage bandgap reference circuit of claim 1, wherein the temperature coefficient of said output reference voltage is determined by the ratio of said first resistive means over said second resistive means.

11. The low voltage bandgap reference circuit of claim 1, wherein the value of said third resistive means is proportional to the value of said temperature independent output reference voltage.

12. A low voltage bandgap reference circuit, comprising:

a reference circuit for generating first and second reference voltages, respectively, said reference circuit further comprising:

a first current source having first, second, and third outputs;

a first diode element coupled between said first output of said first current source and a common node, said first diode elements defining a first diode voltage which is said first reference voltage, said first reference voltage having a negative temperature coefficient;

a second diode element in series with a first resistive means coupled between said second output of said first current source and a common node, said second diode element defining a second diode voltage;

a second resistive means coupled between said third output of said first current source and said common node, said second resistive means defining a voltage drop which is said second reference voltage, said second reference voltage having a positive temperature coefficient; and a first amplifier having an output coupled to control said first current source in response to a signal at a first input coupled to said first diode element and a signal at a second input coupled to said second output of said first current source;

a first amplifying circuit coupled to said reference circuit to generate a current directly proportional to said first reference voltage and the reciprocal of a third resistive means, said first amplifying circuit further comprising:

a second current source having fourth and fifth outputs;

said third resistive means coupled between said fourth output of said second current source and said common node; and a second amplifier having an output coupled to control said second current source in response to a signal at a first input of said second amplifier coupled to said first diode element and a signal at a second input of said second amplifier coupled to said fourth output of said second current source;

a second amplifying circuit coupled to said reference circuit to generate a current directly proportional to said second reference voltage and the reciprocal of a fourth resistive means, said second amplifying circuit further comprising:

a third current source having sixth and seventh outputs;

said fourth resistive means coupled between said sixth output of said third current source and said common node; and a third amplifier having an output coupled to control said third current source in response to a signal at a first input of said third amplifier coupled to said second resistive means and a signal at a second input of said third amplifier coupled to said sixth output of said third current source; and a summing circuit coupled to said fifth and seventh outputs of said second and third current source, respectively, said summing circuit summing the currents of said first and said second amplifying circuit, thereby generating a temperature independent output reference voltage which is proportional to the impedance of said summing circuit.

13. The low voltage bandgap reference circuit of claim 12, wherein current source transistors in said first current source have the same width-to-length ratio.

14. The low voltage bandgap reference circuit of claim 12, wherein said first and second diode elements have an area ratio of 1:M, where M is larger than 1.

15. The low voltage bandgap reference circuit of claim 12, wherein said second reference voltage with a positive temperature coefficient is derived from the ratio of said second and said first resistive means and the area ratio of said first and second diode elements.

16. The low voltage bandgap reference circuit of claim 12, wherein current source transistors in said second current source have the same width-to-length ratio.

17. The low voltage bandgap reference circuit of claim 12, wherein current source transistors in said third current source have the same width-to-length ratio.

18. The low voltage bandgap reference circuit of claim 12, wherein current source transistors in said second current source have a width-to-length ratio of N:1, where N is larger than or equal to 1.

19. The low voltage bandgap reference circuit of claim 12, wherein said current source transistors in said third current source have a width-to-length ratio of P:1, where P is larger than or equal to 1.

20. The low voltage bandgap reference circuit of claim 12, wherein the temperature coefficient of said output reference voltage is determined by the ratio of said impedance over said third resistive means and said impedance means over said fourth resistive means.

21. The method of generating a low voltage bandgap reference circuit, comprising the steps of:

a) providing first and second reference voltages with positive and negative temperature coefficients, respectively;

b) providing a first amplifying circuit with a first resistor and a first and a second current source to generate a first current directly proportional to said first reference voltage and the reciprocal of said first resistor;

c) providing a second amplifying circuit with a second resistor and a third and a fourth current source to generate a second current directly proportional to said second reference voltage and the reciprocal of said second resistor;

d) creating a bandgap reference voltage independent of temperature by choosing suitable values for said second and first resistor;

e) generating said temperature independent bandgap reference voltage by summing currents of said second and said fourth current source in a third resistor; and f) selecting a fractional, temperature independent bandgap reference voltage by selecting a specific value for said third resistor.

* * * * *